US006315596B1

(12) United States Patent
Chen

(10) Patent No.: US 6,315,596 B1
(45) Date of Patent: Nov. 13, 2001

(54) WIRING APPARATUS OF ELECTRICAL CONNECTOR

(75) Inventor: Michael Chen, Taipei (TW)

(73) Assignee: Surtec Industries Inc., Taipei (TW)

( * ) Notice: Subject to any disclaimer, the term of this patent is extended or adjusted under 35 U.S.C. 154(b) by 0 days.

(21) Appl. No.: 09/695,052

(22) Filed: Oct. 25, 2000

(51) Int. Cl.[7] ..... H01R 4/24
(52) U.S. Cl. ..... 439/417
(58) Field of Search ..... 439/417, 374, 439/376, 402, 404, 405, 418

(56) References Cited

U.S. PATENT DOCUMENTS 4,648,678 3/1987 Archer .
5,498,172 * 3/1996 Noda ..... 439/417
5,624,274 * 4/1997 Lin ..... 439/417
5,674,093 10/1997 Vaden .

* cited by examiner

*Primary Examiner*—Brian Sircus
*Assistant Examiner*—Phuong Dinh
(74) *Attorney, Agent, or Firm*—Birch, Stewart, Kolasch & Birch, LLP

(57) ABSTRACT

A wiring apparatus of an electrical connector includes a pressing cover to be mounted on a plurality of piercing terminals of the electrical connector. The pressing cover is formed with a plurality of concave portions for guiding and separating the communication wires into specific positions when the pressing cover being fastened to the piercing terminals for fixing the wires. That is, the second pair and the fourth pair are allocated at both sides. The first pair and the third pair are in the middle. A guiding means is further used to tightly collect and fix the wires of first pair together, and to separate the wires of third pair to both sides of the first pair. Therefore, the pairs of wires are well allocated into specific positions to achieve a stable data transmission.

4 Claims, 6 Drawing Sheets

WIRING APPARATUS OF ELECTRICAL CONNECTOR

BACKGROUND OF THE INVENTION

1. Field of Invention

The present invention generally relates to a wiring apparatus of an electrical connector applicable to transmit electrical signals, and more particularly relates to a wiring apparatus of an electrical connector, which can separate the communication wires for a stable signal transmission.

2. Related Art

Information transmissions through network communication are recently more and more popular. The applications are getting wider. As a demand, the high speed and high efficiency transmissions require high quality cabling and connectors. Generally, the network communication paths are composed of transmission media and electrical connectors. On the transmission media, there are twisted pair cables, coaxial cables, and optical fibers. There are a certain defects occurred in the communication paths which will get worsen as the frequency of signals getting higher.

Taking unshielded twisted pair (UPT) cabling for example, the cable includes two isolated copper wires twisted with a certain pitch and a certain manner. A pair or two pairs of twisted cables constitute a communication chain as a simplest transmission medium. The twisted pairs are commonly used in computer communication networks. But, cross talk is induced due to capacitive and inductive couplings between adjacent conductors. Especially when the frequency of the signal increases, the magnitude of the cross talk is logarithmically increased, and the impedance also increases, which badly attenuate the high frequency signal.

There have been prior arts to solve the problem of decreased performance in transmitting higher frequency signals. For example, in U.S. Pat. No. 4,648, 678, the adjacent terminals for a connector are settled on two different planes. A further improvement of connector disclosed by U.S. Pat. No. 5,674,093 is to differentiate the bending angles of adjacent terminal legs, so that the adjacent terminal legs are not parallel to each other, and, the electrical signal transmission characteristics of said connector is enhanced.

Though the prior arts intended to solve the aforesaid problem, they are rare to talk about the wiring method for the communication wires. Actually, when the communication wires are inappropriately installed, the transmission performance will obviously decreased and cause problem.

SUMMARY OF THE INVENTION

The present invention is therefore to provide a wiring apparatus of an electrical connector, which is applicable to transmit electrical signals. The wiring apparatus can separate the communication wires locating on the piercing terminals according to their pair distinction and achieve a stable signal or data transmission.

To achieve the aforesaid objects, a wiring apparatus of an electrical connector according to the present invention includes a pressing cover to be mounted on a plurality of piercing terminals of the electrical connector. The pressing cover is formed with a plurality of concave portions for guiding and separating the communication wires into specific positions when the pressing cover is fastened to the piercing terminals for fixing the wires. That is, the second pair and the fourth pair are allocated at both sides. The first pair and the third pair are allocated in the middle. A guiding means is further used to tightly collect and fix the first pair of wires together, and to separate the third pair of wires to both sides of the first pair. Therefore, the pairs of wires are well allocated into specific positions to achieve a stable signal or data transmission.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
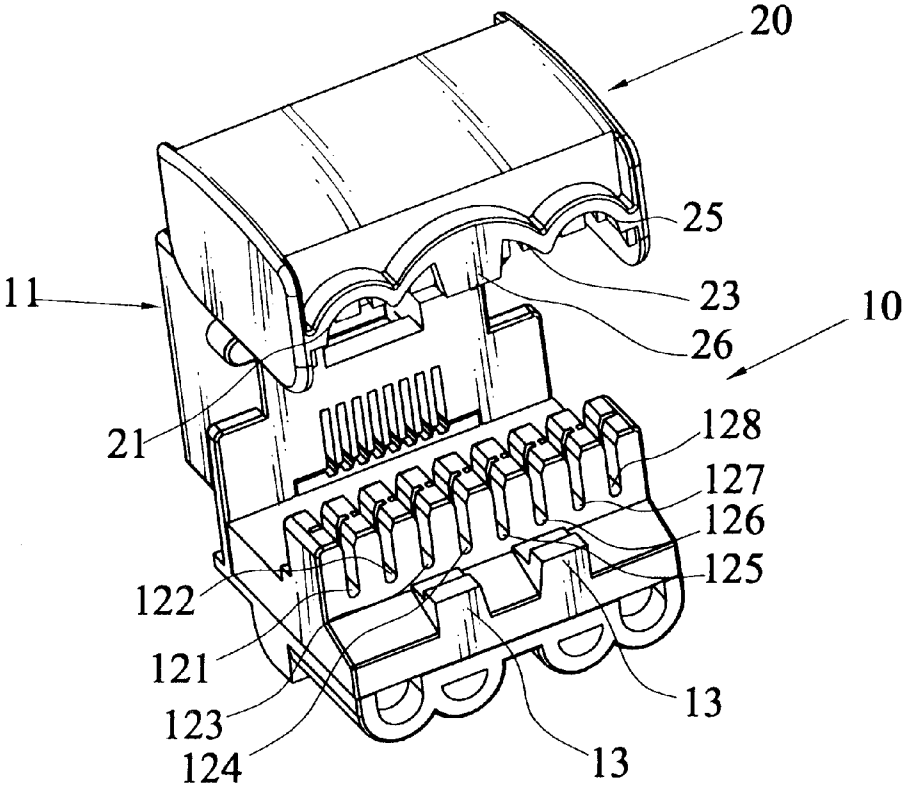
FIG. 1 is an exploded view of a wiring device of an electrical connector according to the present invention.
Figure 2A:
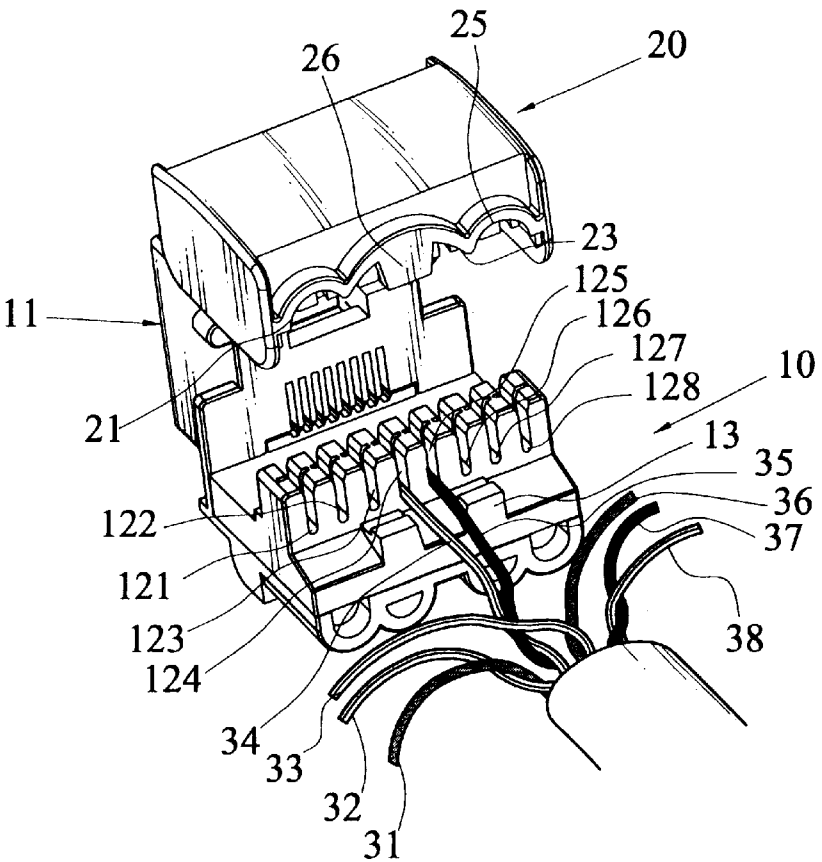
FIGS. 2A, 2B are sequential application views of the wiring apparatus of electrical connector according to the present invention.
Figure 2B:
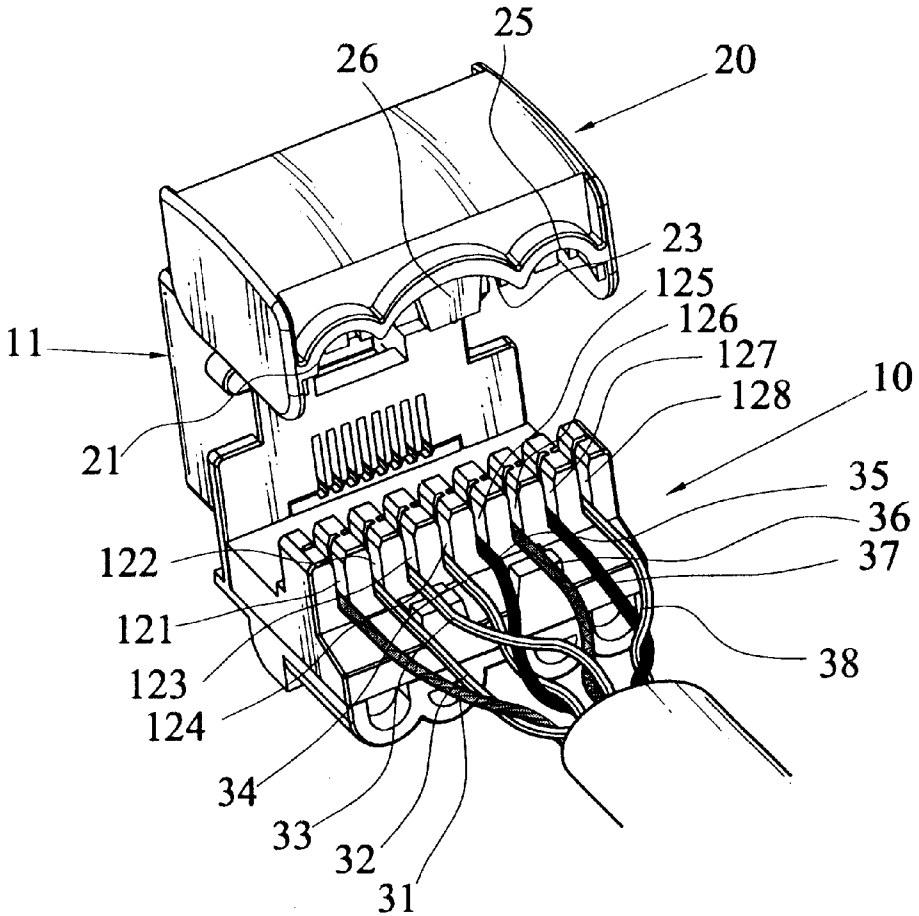

As shown in FIG. 1, a wiring apparatus of an electrical connector according to the present invention includes a connector body 10, which is formed with a network terminal socket 11 at one end, and a plurality of piercing terminals 121~128 at the other end. The terminal socket 11 is for connecting a network plug, while the piercing terminals 121~128 are for connecting communication wires 31~38 (as shown in FIGS. 2A, 2B) for signal or data transmission. A pressing cover 20 is used to fix the communication wires 31~38 into the piercing terminals 121~128.

Taking a cable of EIA/TIA T568B for example, the communication wires 34, 35 are the first pair; the wires 31, 32 are the second pair; the wires 33, 36 are the third pair; and the wires 37, 38 are the fourth pair. Correspondingly, the piercing terminals 124, 125 are the first pair terminals; the piercing terminals 121, 122 are the second pair terminals; the piercing terminals 123, 126 are the third pair terminals; and the piercing terminals 127, 128 are the fourth pair terminals. The first pair of wires 34, 35 are allocated in the first pair terminals 124, 125; the second pair of wires 31, 32 are allocated in the second pair terminals 121, 122; the third pair of wires 33, 36 are allocated in the third pair terminals 123, 126; and the fourth pair of wires 37, 38 are allocated in the fourth pair terminals 127, 128.

The pressing cover 20 is formed with three concave portions 21, 23, 25 for guiding and separating the communication wires into specific positions when the pressing cover 20 being fastened to the piercing terminals 121~128 for fixing the wires 31~38. That is, the second pair of wires 31, 32 and the fourth pair of wires 37, 38 are allocated in the outer concave portions 21, 25 on both sides. The first pair of wires 34, 35 and the third pair of wires 33, 36 are allocated in the middle concave portion 23. A guiding means is further used to tightly collect and fix the first pair of wires 34, 35 together, and separate the third pair of wires 33, 36 to both sides of the first pair 34, 35.

As shown in FIG. 1, in a first embodiment of the present invention, the guiding means are two extrusions 13 formed on the piercing terminals of the connector body 10 at both sides of the first pair of wires 34, 35; and a pressing portion 26 formed on the pressing cover 20. By functions of the two extrusions 13 and the pressing portion 26, the first pair of wires 34, 35 are collected tightly in the gap between the extrusions 13; and the third pair of wires 33, 36 are separated by the pressing portion 26 to both sides of the pressing portion 26.

In assembly of the wires 31~38, as shown in FIG. 2A, the first pair of wires 34, 35 are first pressed into the piercing terminals 124, 125, and allocated between the two extrusions 13. Then, the rest wires 31, 32, 33, 36, 37, 38 are allocated into the piercing terminals 121, 122, 123, 126, 127 and 128 respectively, as shown in FIG. 2B.

Figure 3:
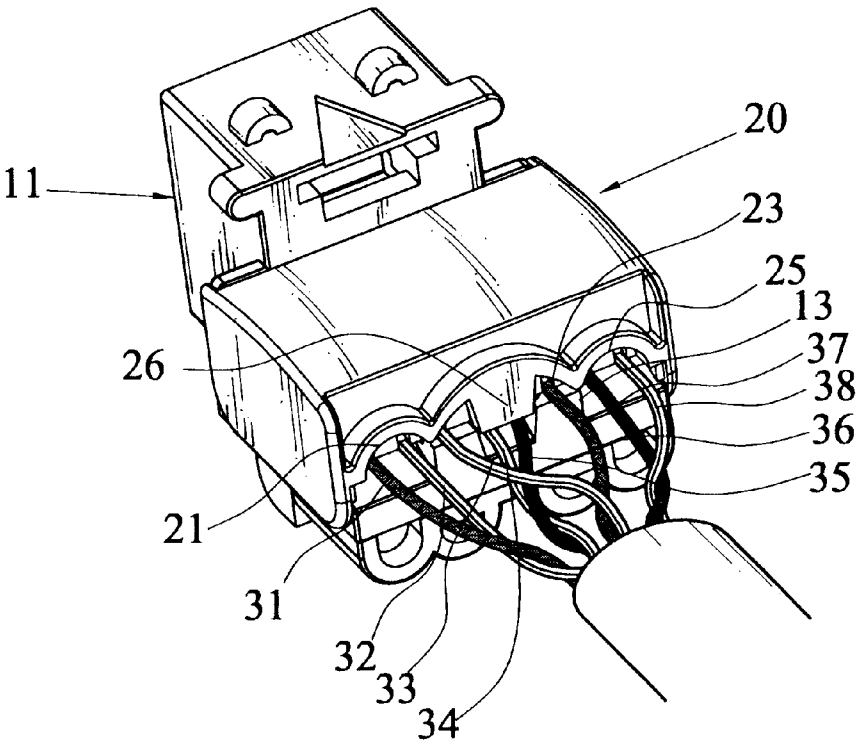
FIG. 3 is an application view of the wiring apparatus of electrical connector according to the present invention showing the wires being fixed.

Then, the pressing cover 20 is mounted on the piercing terminals 121~128 to separate the wires 31~38 into specific positions, as shown in FIG. 3. The second pair of wires 31, 32 and the fourth pair of wires 37, 38 are allocated in the outer concave portions 21, 25 on both sides. The first pair of wires 34, 35 are tightly collected by the extrusions 13 into the gap between the extrusions 13. The third pair of wires 33, 36 are separated by the pressing portion 26 to both sides of the pressing portion 26. Therefore, the communication wires 31~38 are separately allocated according to their pair distinction, which will achieve a stable data transmission.

Figure 4:
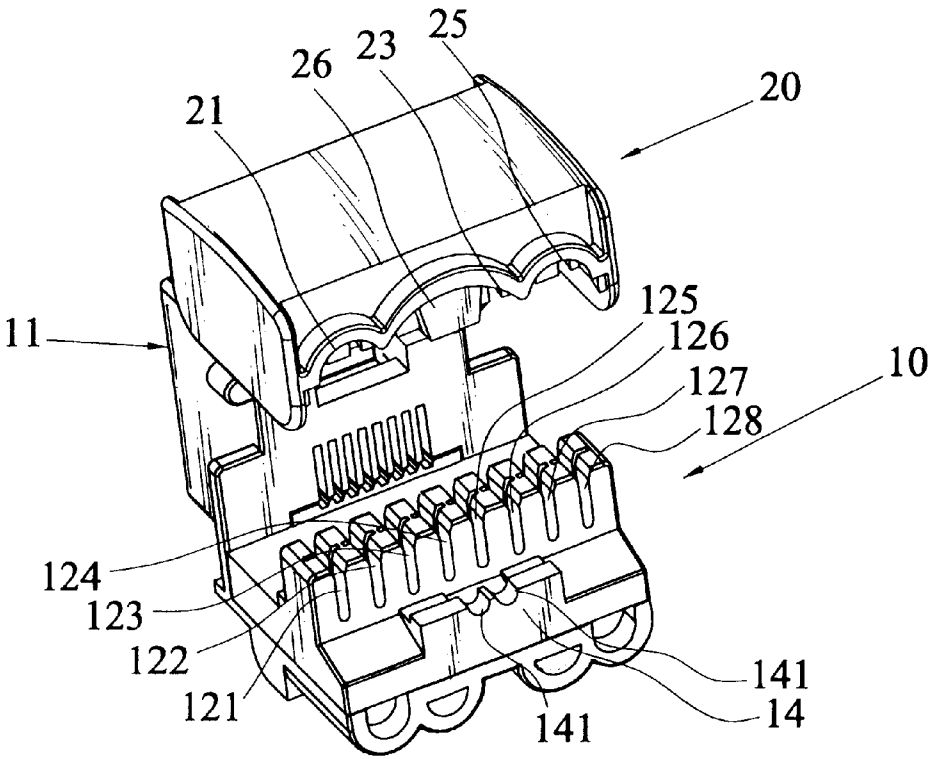
FIG. 4 is an exploded view of a wiring device of an electrical connector as a second embodiment of the present invention.

FIG. 4 shows a second embodiment of the present invention in which the guiding means include an extrusion 14 formed on the piercing terminals of the connector body 10 at the first pair of wires 34, 35; and a pressing portion 26 formed on the pressing cover 20. Two grooves 141 are formed on the extrusion 14 for holding the first pair of wires 34, 35 in place. By functions of the extrusion 14 and the pressing portion 26, the first pair of wires 34, 35 are near allocated in the grooves 141; and the third pair of wires 33, 36 are separated by the pressing portion 26 to both sides of the pressing portion 26.

Figure 5:
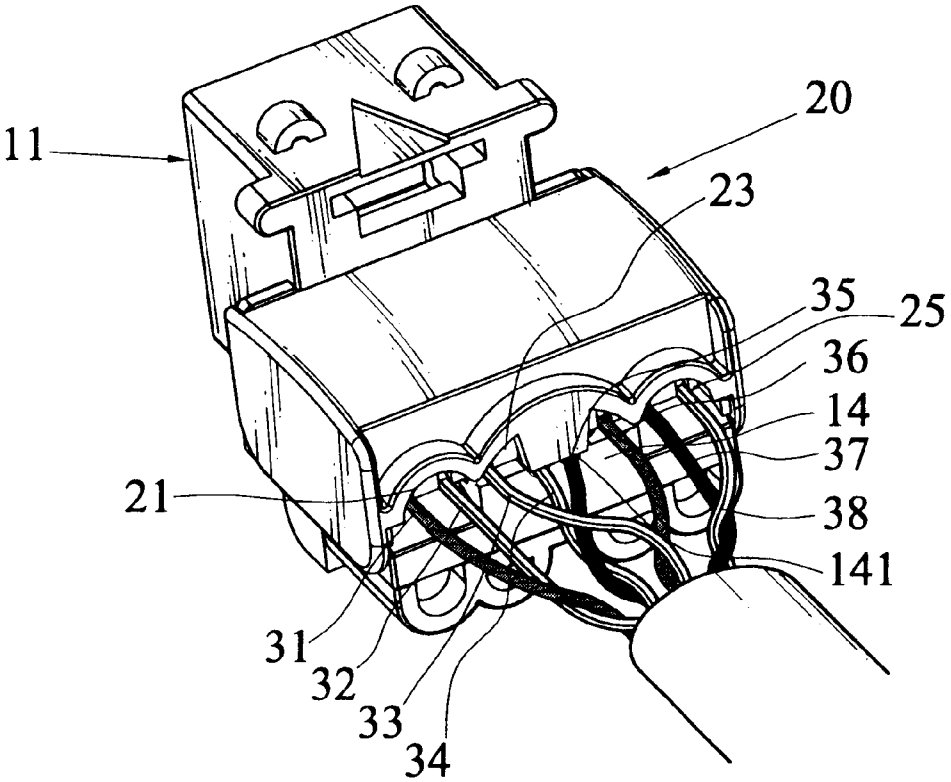
FIG. 5 is an application view of the wiring apparatus of electrical connector of FIG. 4 showing the wires being fixed.

As shown in FIG. 5, by using the second embodiment of the present invention, the wires 31~38 can also be separately allocated according to their pair distinction, and achieve a stable data transmission.

As described above, the wiring apparatus of electrical connector according to the present utilizes a pressing cover mounted on the piercing terminals to separate the communication wires according to their pair distinction, which will improve the transmission performance by a simple construction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A wiring apparatus for an electrical connector comprising:

a connector body having a first end and a second end;

a terminal socket on the first end of said connector body for connecting to a network plug;

a plurality of communication wires;

a plurality of piercing terminals on the second end of said connector body for mounting the plurality of communication wires;

a pressing cover having a plurality of concave portions for guiding and separating said communication wires into specific positions when fastened to said piercing terminals, said communication wires including a first pair, a second pair, a third pair and a fourth pair of communication wires, said first pair and said third pair of wires positioned between said second and said fourth pairs of wires, wherein the first pair of communication wires are positioned in a position offset and lower than a position of said third pair of communication wires when said terminal socket is connected to said piercing terminals for eliminating cross talk between said first pair of communication wires and said third pair of communication wires; and guiding means having a pair of extrusions sandwiching the first pair of communication wires for tightly collecting and fixing said first pair of wires on the connector body near the piercing terminals, and separating said third pair of communication wires in a position sandwiching said first pair of communication wires.

2. The wiring apparatus according to claim 1, wherein said guiding means further comprises:

a pressing portion on said pressing cover, the pair of extrusions on the piercing terminals of the connector body in a position permitting an interlocking engagement with said pressing portion; and a gap formed between said pair of extrusions, said first pair of communication wires tightly collected in the gap.

3. The wiring apparatus for an electrical connector comprising:

a connector body having a first end and a second end;

a terminal socket on the first end of said connector body for connecting to a network plug;

a plurality of communication wires;

a plurality of piercing terminals on the second end of said connector body for mounting the plurality of communication wires;

a pressing cover having a plurality of concave portions for guiding and separating said communication wires into specific positions when fastened to said piercing terminals, said communication wires including a first pair, a second pair, a third pair and a fourth pair of communication wires, said first pair and said third pair of wires positioned between said second and said fourth pairs of wires, wherein the first pair of communication wires are positioned in a position offset and lower than a position of said third pair of communication wires when said terminal socket is connected to said piercing terminals for eliminating cross talk between said first pair of communication wires and said third pair of communication wires; and guiding means having an extrusion sandwiching the first pair of communication wires for tightly collecting and fixing said first pair of wires on the connector body near the piercing terminals, and separating said third pair of communication wires in a position sandwiching said first pair of communication wires.

4. The wiring apparatus according to claim 3, further comprising:

a pressing portion formed on said pressing cover; and the extrusion formed on the piercing terminals of the connector body in the vicinity of the first pair of communication wires includes two grooves for holding said first pair of communication wires.

* * * * *